US006397909B1

(12) United States Patent
Nelson

(10) Patent No.: US 6,397,909 B1
(45) Date of Patent: Jun. 4, 2002

(54) APPARATUS AND METHOD FOR DISPENSING A CARBONATED BEVERAGE WITH MINIMAL/CONTROLLED FOAMING UNDER SYSTEM PRESSURE

(75) Inventor: Patrick L. Nelson, Sun Prairie, WI (US)

(73) Assignee: Dispensing Systems, Inc., Madison, WI (US)

( * ) Notice: Subject to any disclaimer, the term of this patent is extended or adjusted under 35 U.S.C. 154(b) by 0 days.

(21) Appl. No.: 09/704,875

(22) Filed: Nov. 2, 2000

Related U.S. Application Data

(60) Provisional application No. 60/163,415, filed on Nov. 3, 1999.

(51) Int. Cl.[7] ..... B65B 1/04
(52) U.S. Cl. ..... 141/356; 141/374; 141/263
(58) Field of Search ..... 141/356, 374, 141/263, 192, 2, 18, 193; 222/129.1; 251/339

(56) References Cited

U.S. PATENT DOCUMENTS

| | | | | |
|---|---|---|---|---|
| 2,380,884 | A | 7/1945 | Stoeser et al. | 225/21 |
| 2,893,444 | A | 7/1959 | Waddington et al. | 141/89 |
| 3,047,033 | A | 7/1962 | Rosen | 141/284 |
| 3,252,654 | A | 5/1966 | Deutch | 235/94 |
| 3,718,233 | A | 2/1973 | Nordoff | 222/70 |
| 3,779,292 | A | 12/1973 | Mencacci | |
| 3,881,636 | A | 5/1975 | D'Aubreby | 222/129.4 |
| 3,978,900 | A | 9/1976 | Mencacci et al. | |
| 4,202,387 | A | 5/1980 | Upton | 141/360 |
| 4,333,504 | A | 6/1982 | Golding | 141/55 |
| 4,360,128 | A | 11/1982 | Neumann | 222/26 |
| 4,675,660 | A | 6/1987 | Boscolo | 340/612 |
| 4,685,598 | A | 8/1987 | Nezworksi | 222/400 |
| 4,715,414 | A | 12/1987 | Harrison et al. | 141/302 |
| 4,737,037 | A | 4/1988 | Mojonnier | 366/152 |
| 4,744,395 | A | 5/1988 | Ziegler | 141/95 |
| 4,762,251 | A | 8/1988 | Berger | 222/49 |
| 4,895,194 | A | 1/1990 | McCann et al. | 141/198 |
| 4,949,764 | A | 8/1990 | Clüsserath | 141/6 |
| 4,976,295 | A | 12/1990 | Clüsserath | 161/39 |
| 5,129,548 | A | 7/1992 | Wisiewski | 222/16 |
| 5,163,582 | A | 11/1992 | Godolphin et al. | 222/1 |
| 5,203,474 | A | 4/1993 | Haynes | 222/129 |
| 5,219,008 | A | 6/1993 | Shannon | 141/83 |
| 5,228,486 | A | 7/1993 | Henninger | 141/95 |
| 5,268,849 | A | 12/1993 | Howlett et al. | 365/478 |
| 5,474,113 | A | 12/1995 | Rademacher et al. | |
| 5,566,732 | A | 10/1996 | Nelson | 141/94 |
| 5,603,363 | A | 2/1997 | Nelson | 141/351 |

FOREIGN PATENT DOCUMENTS

| | | |
|---|---|---|
| DE | 3435725 A1 | 9/1984 |
| EP | 0 861 801 A1 | 9/1998 |

*Primary Examiner*—Gregory Huson
*Assistant Examiner*—Khoa Huynh
(74) *Attorney, Agent, or Firm*—George E. Haas; Quarles & Brady LLP

(57) ABSTRACT

An apparatus and method for dispensing carbonated beverages into an open container uses a bottom filling technique in which the outlet port of the nozzle is proximate to a bottom of the open container when dispensing is initiated. The carbonated beverage is maintained in a pressurized state within the nozzle and the remainder of the system, until immediately prior to opening a valve to dispense the carbonated beverage into the open container. Prior to opening valve, the pressure of the carbonated beverage nozzle is reduced to an appropriate dispensing pressure, preferably slightly above atmospheric pressure, by slightly enlarging the nozzle volume.

6 Claims, 1 Drawing Sheet

FIG. 1
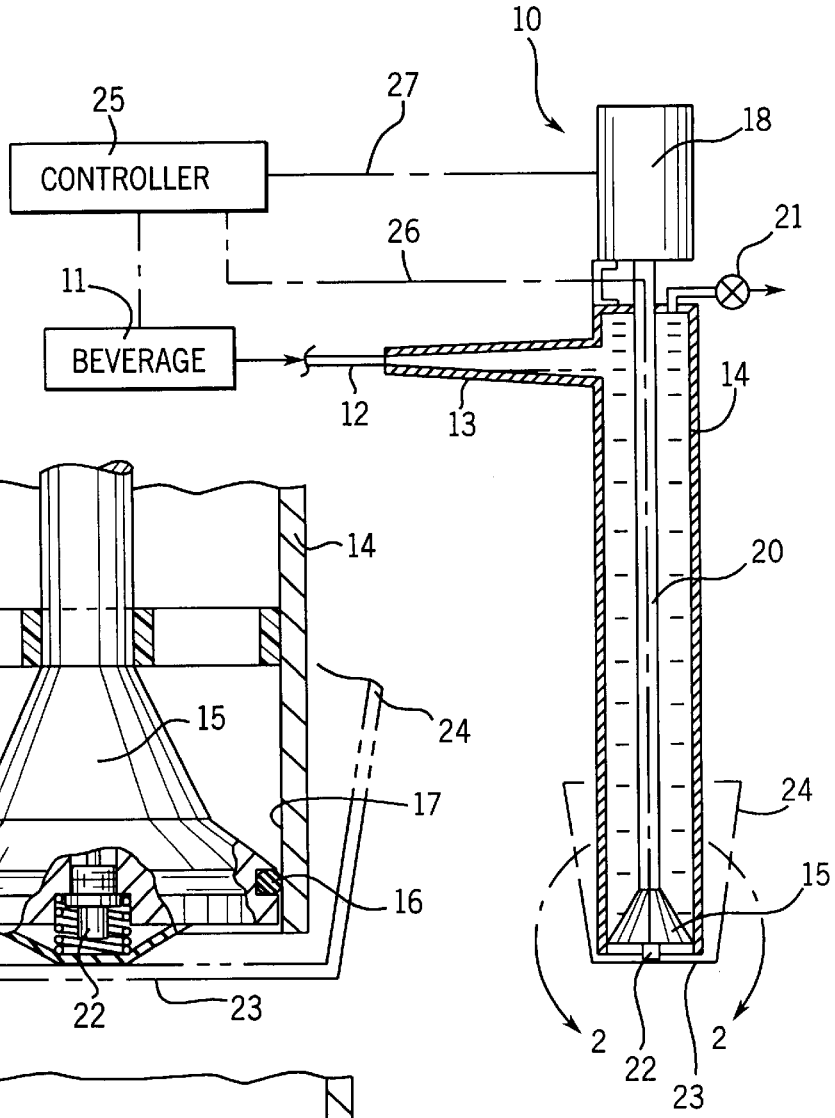
FIG. 2
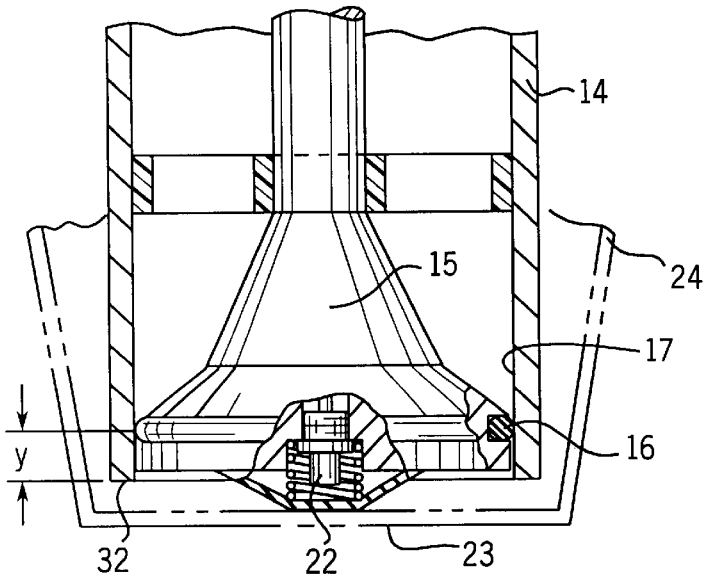
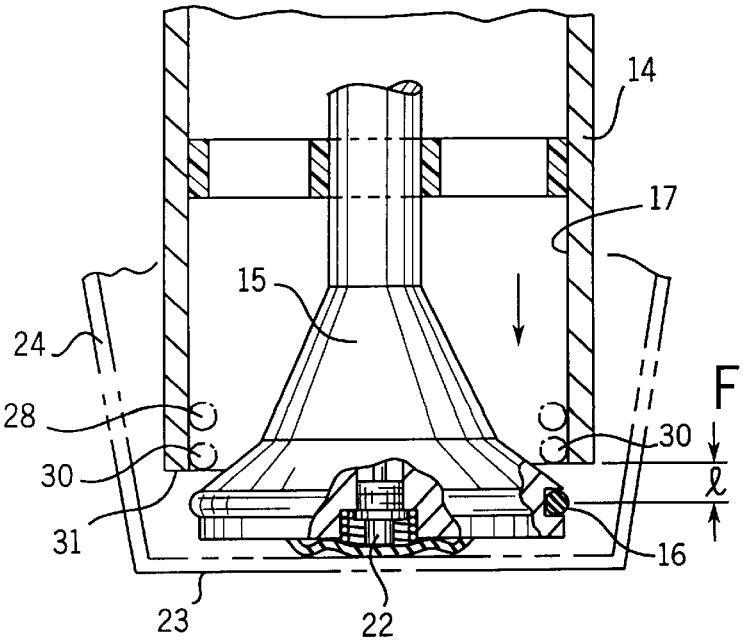
FIG.3

APPARATUS AND METHOD FOR DISPENSING A CARBONATED BEVERAGE WITH MINIMAL/CONTROLLED FOAMING UNDER SYSTEM PRESSURE

This application claims benefit of Prov. No. 60/163,415 filed Nov. 3, 1999.

BACKGROUND OF THE INVENTION

The invention relates to the dispensing of a carbonated beverage into open containers.

The present invention arose during ongoing efforts by the inventor to improve carbonated beverage dispensing systems. In U.S. Pat. No. 5,603,363 entitled "Apparatus For Dispensing A Carbonated Beverage With Minimal Foaming", issuing on Feb. 18, 1997, and in U.S. Pat. No. 5,566,732 issuing on Oct. 22, 1996, the inventor discloses systems for dispensing carbonated beverage, such as beer or soda, into an open container. The system disclosed in U.S. Pat. No. 5,603,363 discloses the bottom filling of carbonated beverage into an open container. U.S. Pat. No. 5,566,732 discloses the use of a bar code reader to read indicia on the open container when placed beneath the nozzle that indicates the volume of the open container in order to automate the dispensing procedure, and preferably various aspects of on site accounting and inventory procedures. In these systems, the carbonated beverage is dispensed from a nozzle that has an outlet port placed near the bottom of the open container, i.e. the open container is bottom filled. In addition to bottom filling, these systems control the dispensing pressure of the carbonated beverage as well as its temperature in order to minimize foaming. In the above incorporated U.S. patents, the dispensing pressure is controlled by maintaining the pressure of the carbonated beverage to be dispensed at atmospheric pressure. In particular, the carbonated beverage is held in a vented chamber prior to dispensing in order to maintain the pressure at or near atmospheric pressure. The carbonated beverage in the vented chamber is cooled by circulating chilled air around the chamber.

As discussed in the above incorporated patents, carbonated beverage often foams while being dispensed into the serving container using conventional tap filling dispensing systems. As a consequence, personnel operating the dispenser must fill the serving container until the level of foam reaches the brim and then wait for the foam to settle before adding additional carbonated beverage. In some instances, several iterations of this process must occur before the container is filled with liquid to the proper serving level. "Topping Off" necessitated by the foaming of the beverage prolongs the dispensing operation and impedes the ability to fully automate the dispensing of carbonated beverages. Nevertheless, many establishments have push button activated taps which automatically dispense measured quantities of carbonated beverage into different sized containers, such as glasses, mugs and pitchers. Normally, this automated equipment only partially fills the serving container and the user must still manually "top off" the container after the foam from the automated step settles in order to dispense the proper serving quantity.

The system disclosed in U.S. Pat. No. 5,603,363, which uses a vented chamber prior to dispensing the carbonated beverage in order to maintain the pressure in the chamber at or near atmospheric pressure, is particularly well-suited for large volume operations, such as sports arenas, stadiums or other such venues. However, in venues with lower serving volumes, carbonated beverage remaining in the vented chamber may lose some carbonation.

Also, in many applications, it is desirable to control the amount of foaming rather than simply minimize the amount of foaming. For example, when pouring beer, the presentation of the beer and the head in the open container affects the drinkability of the beer along with its serving temperature. This is also generally true of carbonated sort drinks.

SUMMARY OF THE INVENTION

A general object of the present invention is to provide an apparatus for dispensing carbonated beverages into a serving container in a manner which minimizes foaming of the beverage and permits rapid dispensing to occur under a system pressure.

Another object of the present invention is to provide such an apparatus which minimizes shrinkage due to wasted beverage during the dispensing operation.

These and other objectives are fulfilled by a dispenser that has a nozzle which is directly connected to a pressurized system. Carbonated fluid enters the system by opening the purge vent valve allowing fluid to enter the system thus releasing all air from the system. When the air is purged from the system, the system is ready to operate.

A serving container is placed under the nozzle and is moved up until the bottom of the serving container touches the electronic sensor. When the electronic sensor is activated, an air cylinder/electric motor drives a valve stem down that is connected to the valve member. The valve member has an O-ring attached to it. The O-ring is spaced at a distance y from the leading edge of the nozzle. In order to achieve minimal/controlled foaming and minimizing shrinkage, the system pressure must be reduced. The valve member travels a pressure reducing length y expanding the volume thus reducing the system pressure. A diffuser adds system restriction controlling carbonated beverage backpressure. When the valve member travels a distance y, fluid starts to enter the serving container at a pouring angle theta. Pouring angle theta produces a conical shaped stream of carbonated beverage at a laminar rate thus minimizing excessive foaming. Carbonated beverages have large ranges of carbonation levels. Added control takes place when the valve member travels the pressure reducing length y plus the final opening length at varying velocities throughout the cycle.

BRIEF DESCRIPTION OF THE DRAWINGS

FIG. 1 is a schematic elevation view of a carbonated beverage dispensing apparatus in accordance with the present invention.

FIG. 2 is a detail view of the dispensing valve of the apparatus shown in FIG. 1 in its closed position.

FIG. 3 is a view of a portion of the carbonated beverage dispensing apparatus shown in FIG. 2 at a point in time in which the dispensing valve is open and carbonated beverage is dispensing from the system into an open container.

DETAILED DESCRIPTION OF THE INTENTION

It should be understood that various components of the dispensing apparatus 10 shown in FIG. 1, such as a chiller, a source of carbon dioxide, and a source of carbonated beverage are depicted generally by block 11 labeled "beverage" in FIG. 1. The chilled and pressurized carbonated beverage flows from line 12 through a fixed flow control restriction or diffuser 13 directly into a chamber defined by a nozzle 14. The volume of carbonated beverage within the flow control nozzle 14 downstream of the flow control diffuser 13 in FIG. 1 can be less than the volume of the open container. In the system 10, a dispensing valve 15 is located within the nozzle 14 when the valve is closed as shown more specifically in the detailed view of FIG. 2. It is important that the O-ring seal 16, FIG. 2, engage tightly against the inside surface 17 of the nozzle when the valve 15 is in a closed position. The apparatus 10 shown in FIG. 1 has an electronically controlled valve actuator 18 that is connected to a valve stem 20 and controls the position of the valve 15. The valve actuator may 18 comprise a fluid cylinder or an electric motor drive. The apparatus 10 also includes a vent valve 21 that is opened to release air from the system and initially fill the nozzle 14 with beverage.

Upon initiation of the dispensing cycle by the engagement of electronic sensor 22 against the bottom 23 of the open container 24, an electronic controller 25 receives a sensor signal via sensor leads 26 and transmits a control signal through line 27 to instruct the valve actuator 18 (e.g. a servo motor/stepper motor or pneumatic actuator) to move the valve 15 downward within the nozzle 14 prior to opening the valve 15. This operation is illustrated in FIG. 3. The phantom locations for the O-ring seal 16 depicted by reference numerals 28 are an illustrative home position for the O-ring seal 16. The valve 15 is located with the O-ring seal 16 in the home position 28 prior to the initiation of the dispensing cycle, and the carbonated beverage within the nozzle 14 is pressurized. The home position is shown spaced a distance y from the bottom edge 32 of the nozzle. Upon initiation of the dispensing cycle, the electronic controller 25 instructs the valve actuator 18 to move the valve 15 downward so that the O-ring seal 16 is in an intermediate position identified by reference numbers 30 in FIG. 3. At this point in the process, the valve 15 is still closed inasmuch as the O-ring seal 16 prevents the dispensing of carbonated beverage from the outlet port 31 of the nozzle 14. The purpose of moving the valve head 15 from the home position 28 to the intermediate position of 30 is to slightly expand the size of the volume contained within the nozzle 14 in order to reduce the pressure of the carbonated beverage within the nozzle 14. After the pressure has been reduced within the nozzle 14, the electronic controller 25 then moves the valve 15 over a final opening length 1, to the position shown in FIG. 3, in order to allow carbonated beverage to dispense through the outlet port 31 into the open container 24. It may be necessary during the dispensing cycle in the apparatus 10 to open the vent valve 21 momentarily in order to ensure that a proper dispensing pressure is achieved and maintained during the dispensing cycle. Movement of the valve 15 along the pressure reducing length y and/or along the final opening length 1 may be done at varying velocities. Because carbonated beverages have large ranges of carbonation levels, varying the velocity of valve movement permits a more accurate control and "customization" of the pour. The actual final dispensing position may be chosen anywhere along the final opening length 1.

I claim:

1. An apparatus for dispensing carbonated beverage into an open container comprising:

a pressurized source of carbonated beverage;

a downwardly extending nozzle having a volume for containing the carbonated beverage and having an outlet port;

a valve movable in the nozzle to control the flow of carbonated beverage dispensing from the nozzle;

a valve actuator coupled to the valve and being adapted to position the valve initially within the nozzle at a selected distance from the outlet port and to move the valve downwardly over said selected distance prior to opening the outlet port;

an activation sensor that outputs an activation signal; and wherein;

the carbonated beverage is introduced to the downwardly extending nozzle with the valve in a closed position and the carbonated beverage at a pressure that is substantially higher than atmospheric pressure; and prior to opening the valve to dispense the carbonated beverage into the open container, the pressure of the carbonated beverage is reduced by moving the valve downwardly over said selected distance to expand the volume of the nozzle containing the carbonated beverage to provide the reduced pressure that is appropriate for dispensing the carbonated beverage from the nozzle into the open container.

2. The apparatus as set forth in claim 1 wherein the actuator is adapted upon opening to move the valve over a selected opening length to vary the size of the outlet port.

3. The apparatus as set forth in claim 2 wherein said actuator is operative to vary velocity of valve movement over said selected distance and said opening length.

4. An apparatus as recited in claim 1 further comprising a flow restriction device between the pressurized source of carbonated beverage and the downwardly extending nozzle.

5. A method of dispensing carbonated beverage into an open container, the method comprising the steps of:

a) positioning a dispensing valve initially within a downwardly extending nozzle at a selected distance from an outlet port for the nozzle;

b) introducing pressurized carbonated beverage from a source to the downwardly extending nozzle when the dispensing valve is positioned within the nozzle in a closed position to prevent dispensing of the carbonated beverage from the nozzle, the nozzle having a volume which contains the pressurized carbonated beverage at a pressure that is substantially higher than atmospheric pressure;

c) placing the open container underneath the nozzle such that the outlet port for the nozzle is proximate a bottom of the open container;

d) prior to opening the dispensing valve to dispense the carbonated beverage into the open container, moving the dispensing valve downwardly over said selected distance to expand the volume of the nozzle to reduce pressure within the nozzle to a level that is appropriate for dispensing the carbonated beverage from the nozzle into the open container;

e) after the pressure of the carbonated beverage in the nozzle is reduced, opening the dispensing valve to dispense carbonated beverage from the nozzle into the open container; and f) closing the dispensing valve after a predetermined time period.

6. A method as recited in claim 5 wherein the carbonated beverage introduced to the downwardly extending nozzle flows from said source of carbonated beverage and through a flow restriction device before being introduced to the downwardly extending nozzle.

* * * * *